US007597558B2

(12) United States Patent
Mazloompour

(10) Patent No.: US 7,597,558 B2
(45) Date of Patent: Oct. 6, 2009

(54) TRAINING DEVICE AND METHOD OF USING SAME

(75) Inventor: Behnam Mazloompour, Edmond, OK (US)

(73) Assignee: Soccer Wave, L.L.C., Edmond, OK (US)

( * ) Notice: Subject to any disclaimer, the term of this patent is extended or adjusted under 35 U.S.C. 154(b) by 672 days.

(21) Appl. No.: 11/333,947

(22) Filed: Jan. 18, 2006

(65) Prior Publication Data

US 2006/0121429 A1 Jun. 8, 2006

Related U.S. Application Data

(63) Continuation-in-part of application No. 29/243,509, filed on Nov. 23, 2005, now Pat. No. Des. 537,488, which is a continuation of application No. 29/212,711, filed on Sep. 7, 2004, now Pat. No. Des. 517,620.

(51) Int. Cl.
*A63B 69/00* (2006.01)

(52) U.S. Cl. ..... 434/247

(58) Field of Classification Search ..... 434/247, 434/251, 258; 473/194, 415, 431–435; 273/395
See application file for complete search history.

(56) References Cited

U.S. PATENT DOCUMENTS 1,658,097 A * 2/1928 Pierce ..... 273/395
1,689,475 A * 10/1928 Brumder ..... 473/184
2,174,884 A * 10/1939 Kachel ..... 473/434
2,994,968 A * 8/1961 Phillips ..... 434/249
3,895,809 A * 7/1975 Shockley ..... 473/194
D257,874 S * 1/1981 Sheehan et al. ..... D21/817
4,615,528 A * 10/1986 York ..... 473/432
4,703,931 A * 11/1987 Steen ..... 473/435
5,165,690 A * 11/1992 Kelley, Jr. ..... 473/184
5,609,528 A * 3/1997 Kehoe ..... 473/157
RE38,326 E 11/2003 Mapp
D500,829 S * 1/2005 Hadley ..... D21/817
6,846,253 B1 1/2005 Szwalek
6,935,971 B2 8/2005 Piras
2004/0029654 A1* 2/2004 Bates ..... 473/415
2004/0176193 A1* 9/2004 Valliquette ..... 473/435

* cited by examiner

*Primary Examiner*—Kurt Fernstrom
(74) *Attorney, Agent, or Firm*—Dunlap Codding, P.C.

(57) ABSTRACT

A training device having a concave ramp surface with a lower edge and an upper edge. The concave ramp surface has an angle of curvature greater than 90 degrees from the lower edge to the upper edge such that the ball traveling along the concave ramp surface from the lower edge to the upper edge is directed back over the lower edge. The angle of curvature of the concave ramp surface between the lower edge and the upper edge is variable between the first side and the second side of the body member.

11 Claims, 4 Drawing Sheets

TRAINING DEVICE AND METHOD OF USING SAME

CROSS-REFERENCE TO RELATED APPLICATIONS

This application is a continuation-in-part of U.S. Ser. No. 29/243,509, filed Nov. 23, 2005, now U.S. Pat. No. DES, 537,488 which is a continuation of U.S. Ser. No. 29/212,711, filed Sep. 7, 2004, now U.S. Pat. No. DES, 517,620 each of which is incorporated herein by reference in its entirety.

BACKGROUND OF THE INVENTION

1. Field of the Invention

The present invention relates generally to a training device, and more particularly, but not by way of limitation, to an improved training device for returning a ball to a user and methods of using same.

2. Brief Description of Related Art

Sports training aides have been developed to assist a player while practicing a particular sport. Many sports, such as soccer, are considered "team sports" and thus generally require at least two players to practice and/or participate in a game. However, a player may wish to practice his sport without the availability or desire of an additional player.

Many training devices are ball return devices and are predicated on a rebounding system. These training aides are used by individuals practicing a sport, such as soccer, without the presence of an additional player. Existing ball return training aides include spring-loaded nets having a metal stand-up frame. Spring-loaded nets allow an individual to practice a sport, such as soccer, so that when the individual kicks a soccer ball into the net, the ball is returned to the individual so that the individual can immediately kick the ball again. The ball is typically returned to the individual in a manner such that the individual can anticipate the location in which the ball will land when it is returned. Some of the existing ball return training aids allow a ball to be returned at the ground level.

Many sports, such as soccer, require the effective use of various parts of a player's body such as, for example, the head, shoulders, chest, legs, and feet, for controlling and trapping the ball as well as passing and taking shots. Existing ball return training aides, such as those described above, fail to consistently return the ball at a desired location, such as head height or chest height, thereby requiring the presence of an additional player or coach for repetitively practicing these skills. Additionally, existing ball return training aides require assembly of multiple pieces to form the unit.

Therefore, a need exists for an improved training device that permits return of a ball at head height and/or chest height without the need of an additional player while requiring little or no assembly. It is to such a device and method that the present invention is directed.

DETAILED DESCRIPTION OF THE INVENTION

Figure 1:
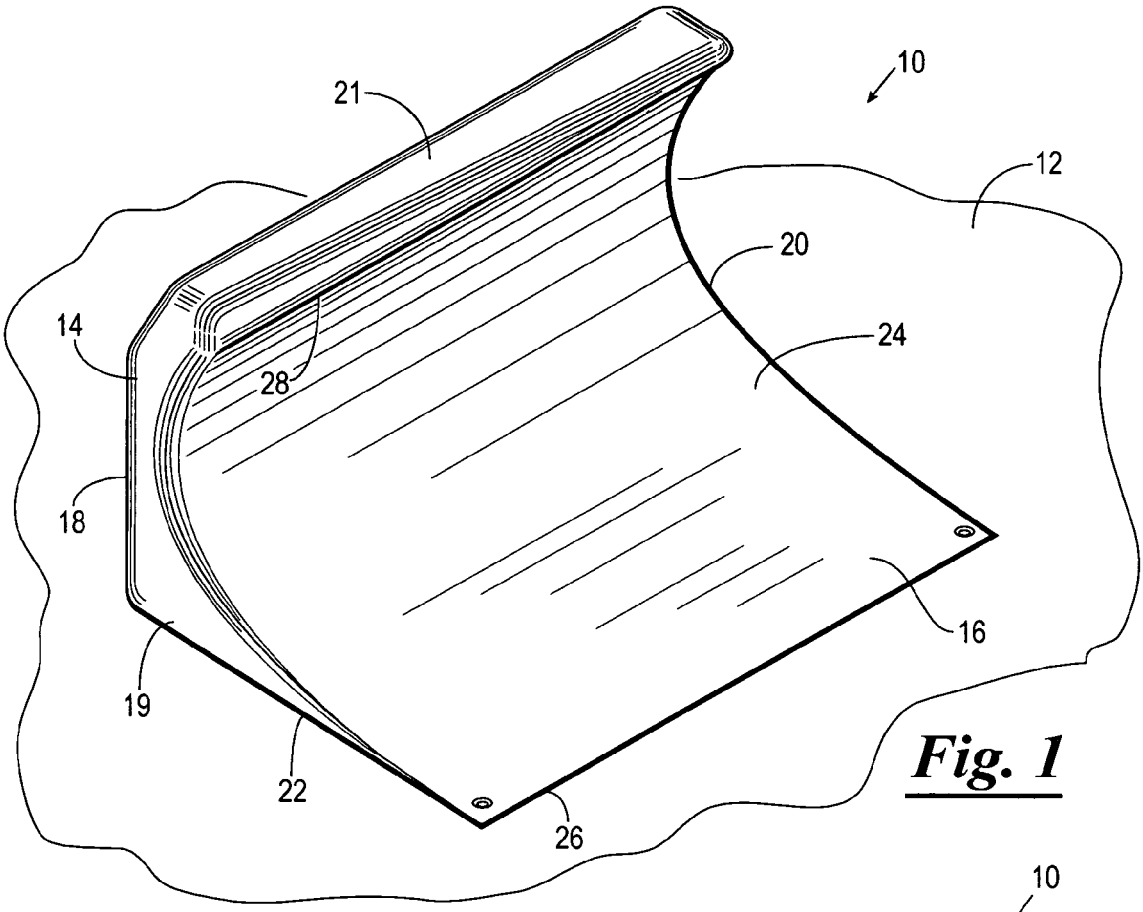
FIG. 1 is a front perspective view of a training device constructed in accordance with the present invention.

Referring now to the drawings, and more particularly to FIG. 1, a training device 10 constructed in accordance with the present invention is shown positioned on a ball support surface 12. Examples of ball support surfaces include a ground, a floor, or any ball support surface 10 suitable for positioning the training device 10 thereon. The training device 10 is used for practicing various sporting activities such as, for example, soccer, and similar sporting activities involving the practice of various sporting techniques without the aid of an additional individual and/or player.

Figure 6A:
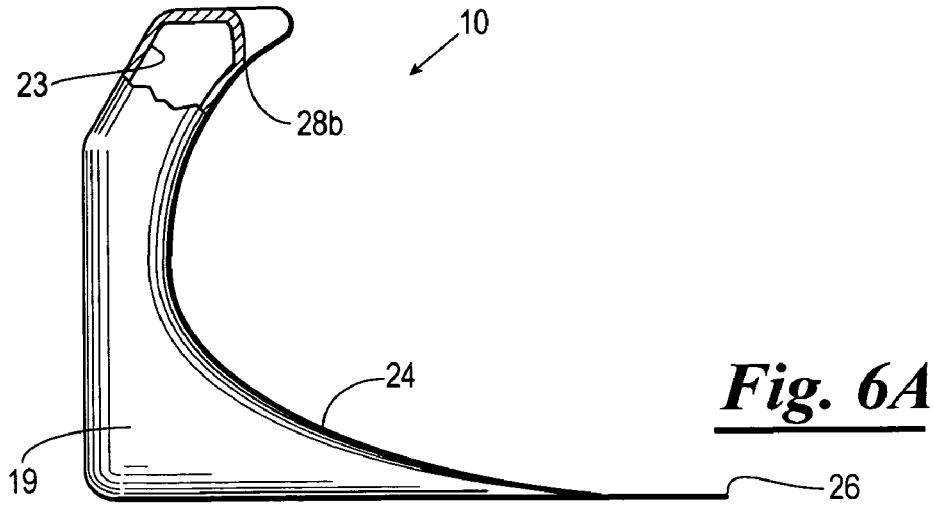
FIG. 6A is a side elevational view cutaway along line 6A-6A of FIG. 3.
Figure 6B:
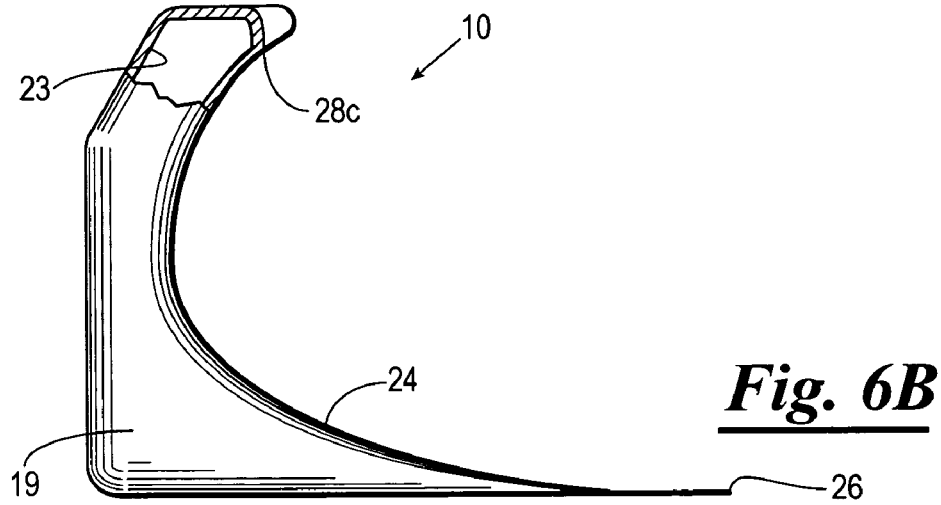
FIG. 6B is a side elevational view cutaway along line 6B-6B of FIG. 3.
Figure 6C:
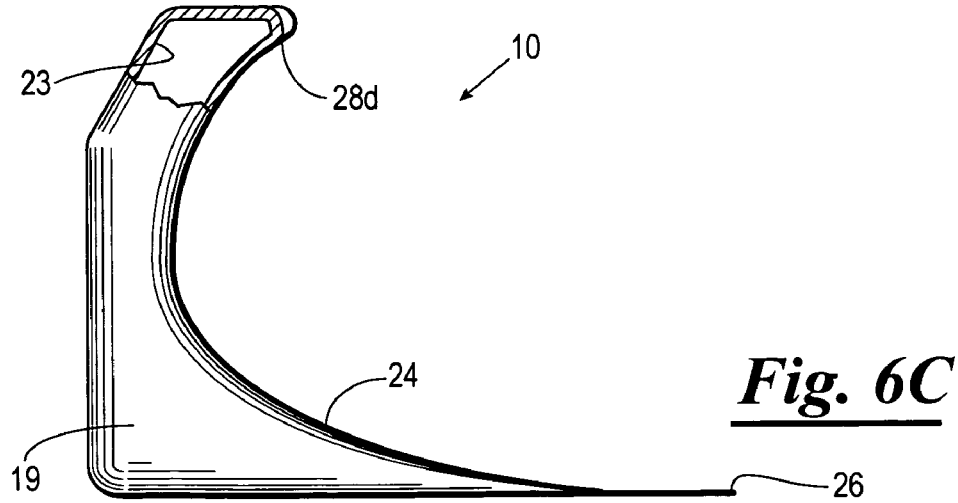
FIG. 6C is a side elevational view cutaway along line 6C-6C of FIG. 3.

The training device 10 includes a body member 14 formed of a suitable material, such as, for example, plastic, or any material sufficiently durable for the uses described herein. Broadly, the body member 14 includes a front end 16, a rear end 18, a first side 19, a second side 20, a top end 21, and a bottom end 22. In one embodiment, the front end 16, the rear end 18, the first side 19, the second side 20, the top end 21, and the bottom end 22 cooperate to define a ballast receiving cavity 23 (FIGS. 6A-6C) for retaining a ballasting material such as, for example, water, sand, gravel, rock, and the like for providing stabilization and weight to the training device 10. In an alternate embodiment, the body member 14 may have a solid core (not shown) thereby eliminating the need for a ballasting material to stabilize the training device 10.

Referring now to FIGS. 1 and 3-6, the front end 16 of the body member 14 is configured to form a concave ramp surface 24. The concave ramp surface 24 has a lower edge 26, an upper edge 28, a first lateral edge 29, and a second lateral edge 30. The concave ramp surface 24 is shown to extend from the lower edge 26 to the upper edge 28 along a direction of extent (represented by line 31 in FIGS. 3 and 4).

The lower edge 26 is shown to be perpendicular to the direction of extent 31. However, it should be appreciated that the lower edge 26 may be oriented at a variety of angles relative to the direction of extent 31 of the concave ramp surface 24. In one embodiment, the concave ramp surface 24 has a uniform width extending between the first lateral edge 29 and the second lateral edge 30.

The lower edge 26 is positionable on the ball support surface 12 so that when a ball (not shown) is put in motion along the ball support surface 12 (FIG. 1), the ball is receivable onto the concave ramp surface 24 via the lower edge 26. The lower edge 26 is configured to define a thin edge so that when the training device 10 is placed on the ball support surface 12, the lower edge 26 is substantially flush with the ball support surface 12 so that the ball has a smooth transition from the ball support surface 12 to the concave ramp surface 24.

A pair of ground anchoring apertures 32 and 33 are located on opposing sides of the concave ramp surface 24 near the lower edge 26 for securing the training device 10 to the ball support surface 12. To secure the training device 10 to the ball support surface 12, a stake (not shown) or similar anchoring device may be positioned in each of the ground anchoring apertures 32 and 33 and driven into the ball support surface 12 using a hammer or similar device. Though the pair of ground anchoring apertures 32 and 33 are shown as being positioned at opposing sides near the lower edge 26, it should be understood that the ground anchoring apertures 32 and 33 may be positioned on the body member 14 in any manner that permits the training device 10 to be secured to the ball support surface 12. In addition, it should be understood that the training device 10 may be secured or anchored to the ball support surface 12 in any manner desired to stabilize the training device for the uses described herein.

The upper edge 28 of the concave ramp surface 24 is vertically spaced from the lower edge 26, and the concave ramp surface 24 is formed to have an angle of curvature greater than 90 degrees from the lower edge 26 to the upper edge 28 such that the ball traveling along the concave ramp surface 24 from the lower edge 26 to the upper edge 28 is directed or looped back over the lower edge 26 and toward the user or a training area located in front of the lower edge 26.

Between the lower edge 26 and the upper edge 28, the radius of curvature of the concave ramp surface 24 is preferably uniform from the first side 19 to the second side 20. The radius of the concave ramp surface 24 between the lower edge 26 and the upper edge 28 should be of sufficient magnitude to permit the ball to travel smoothly along the angle of curvature thereby transitioning from lower edge 26 to the upper edge 28 without prematurely projecting from the training device 10. That is, the radius of the concave ramp surface 24 between the lower edge 26 and the upper edge 28 should be sufficiently sized such that the ball travels along the angle of curvature until exiting the training device 10 via the upper edge 28.

The concave ramp surface 24 is formed to define a ball receiving section 34 extending from the lower edge 26 to a horizontal plane (designated by a line 35) extending normal to the concave ramp surface 24 and a ball return section 36 extending from the horizontal plane 35 to the upper edge 28 of the concave ramp surface 24. In one embodiment, the ball receiving section 34 of the concave ramp surface 24 has a variable radius so as to provide a gradual incline from the ball support surface 12. The radius of the ball return section 36 preferably is constant. For example, in using the training device 10 for practicing the sport of soccer, the radius of the ball return section 36 is preferably about 18 inches in length. It should be understood, however, that other radiuses may be employed and that the radius of the ball return section 34 may be any radius desired, constant or variable, so as to allow the training device 10 to perform in accordance with the intended function described herein.

Figure 3:
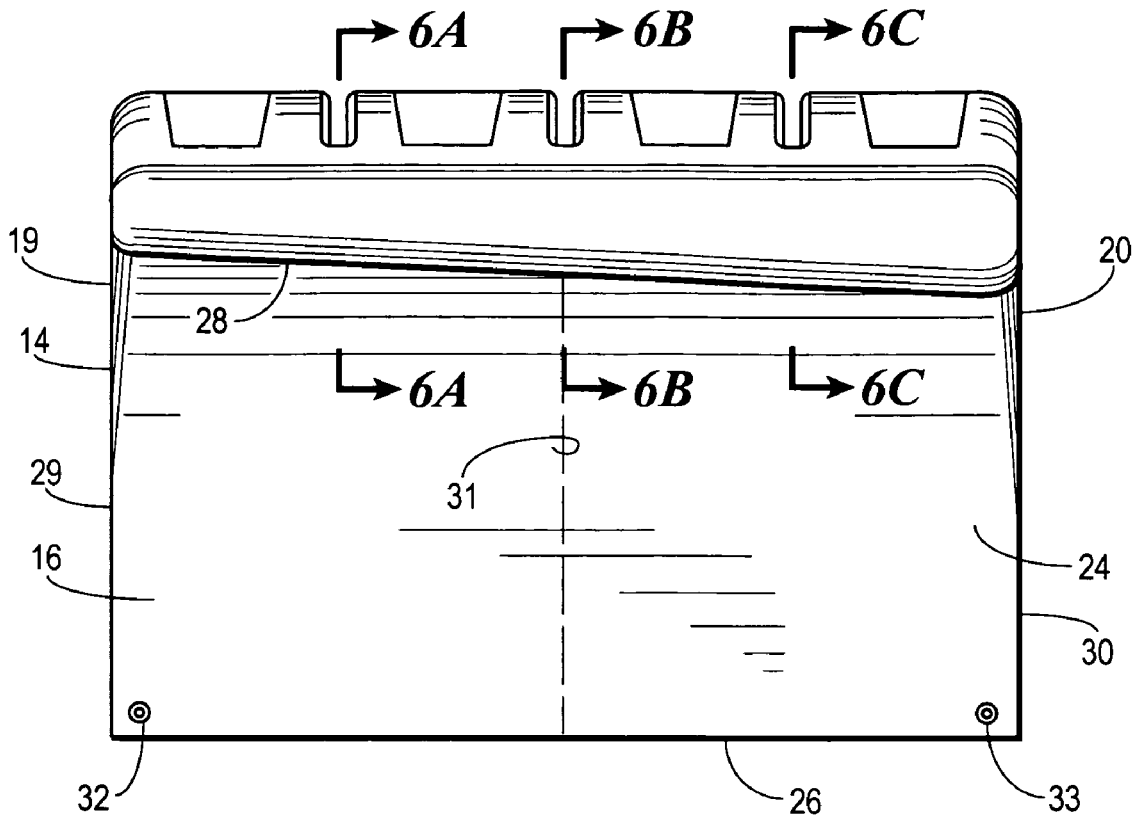
FIG. 3 is a top plan view of the training device of FIG. 1.
Figure 4:
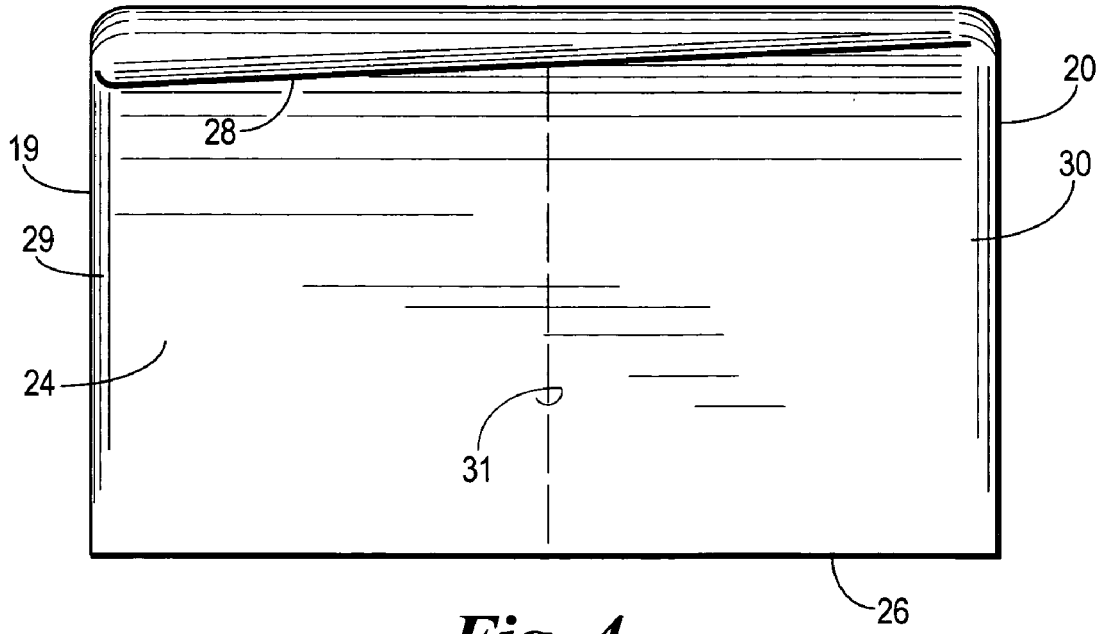
FIG. 4 is a front elevational view of the training device of FIG. 1.
Figure 5:
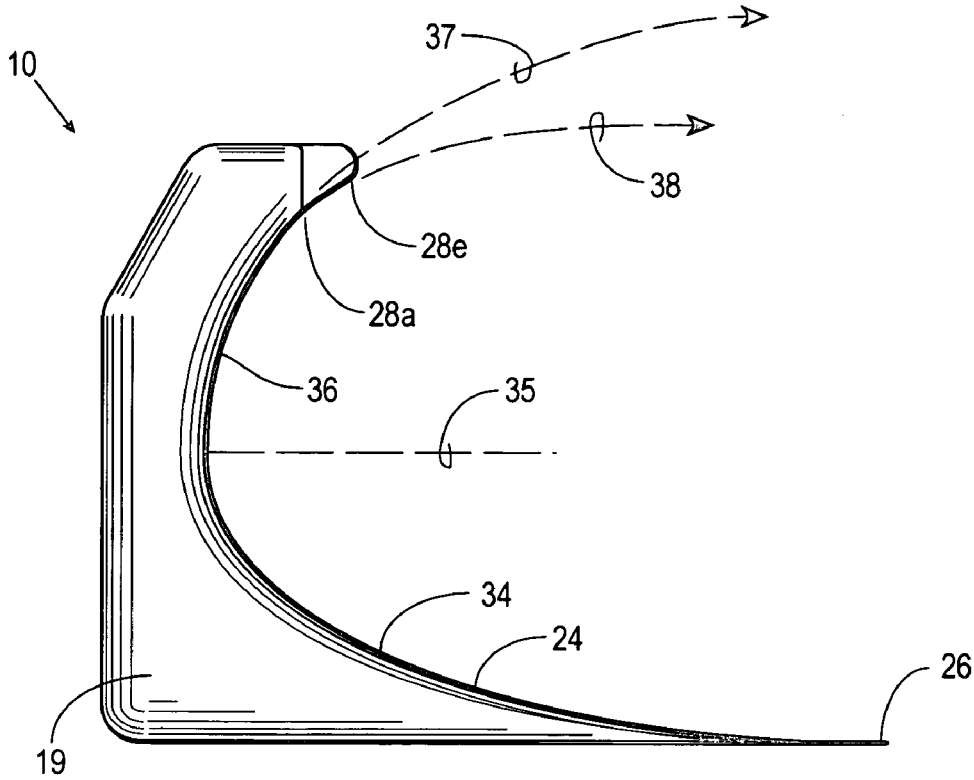
FIG. 5 is a side elevational view of the training device of FIG. 1.

To permit the ball to exit the upper edge 28 at different angles relative to the ball support surface 12 and thereby return to the user at different trajectories, the angle of curvature of the concave ramp surface 24 between the lower edge 26 and the upper edge 28 is variable between the first side 19 and the second side 20 of the body member 14. As best shown in FIG. 3, the upper edge 28 of the concave ramp surface 24 is formed to be in a non-perpendicular relationship with respect to the direction of extent 31 of the concave ramp surface 24 and the upper edge 28 in a non-parallel relationship with respect to the lower edge 26. However, it should be understood that the upper edge 28 may be in a parallel relationship with respect to the lower edge 26 while the upper edge 28 remains in a non-perpendicular relationship with respect to the direction of extent of the concave ramp surface 24 should the lower edge 26 be oriented in a non-perpendicular relationship with respect to the direction of extent 31.

Due to the angled orientation of the upper edge 28 relative to the direction of extent 31 of the concave ramp surface 24, the angle of curvature of the concave ramp surface 24 between the lower edge 26 and the upper edge 28 varies from the first side 19 of the body member 14 to the second side 20 thereof. By way of example, the upper edge 28 may be angled relative to the direction of extent 31 of the concave ramp surface 24 so that the angle of curvature of the concave ramp surface 24 from the lower edge 26 to a point 28*a* of the upper edge 28 located along the first side 19 is about 128° (FIG. 5); the angle of curvature of the concave ramp surface 24 from the lower edge 26 to a point 28*b* of the upper edge 28 (FIG. 6A) is about 131°; the angle of curvature of the concave ramp surface 24 from the lower edge 26 to a point 28*c* of the upper edge 28 (FIG. 6B) is about 134°; the angle of curvature of the concave ramp surface 24 from the lower edge 26 to a point 28*d* of the upper edge 28 (FIG. 6C) is about 137°; and the angle of curvature of the concave ramp surface 24 from the lower edge 26 to a point 28*e* of the upper edge 28 located at the second side 20 (FIG. 5) is about 139°. As a result, the measure of the angle of curvature of the concave ramp surface 24 along the first side 19 of the body member 14 is greater than the measure of the angle of curvature of the concave ramp surface 24 along the second side 20 thereof so that a ball exiting the upper edge 28*a* at or near the first side 19 of the body member 14 (represented by arc 37 in FIG. 5) will exit at a steeper angle greater than a ball exiting the upper edge 28*e* at or near the second side 20 thereof resulting in the ball being directed at a steeper angle which in turn may permit the user to receive the ball at, for example, the head and shoulder areas of the body. In contrast, a ball exiting the upper edge 28*e* at or near the second side 20 of the body member 14 (as represented by arc 38 in FIG. 5) will be received by the user, for example, at or below the waist. As shown in FIG. 3, the upper edge 26 is shown to be substantially straight. Therefore, the angle of curvature of the concave ramp surface 24 varies linearly from the first side 19 of the concave ramp surface 24 to the second side 20 thereof.

Figure 2:
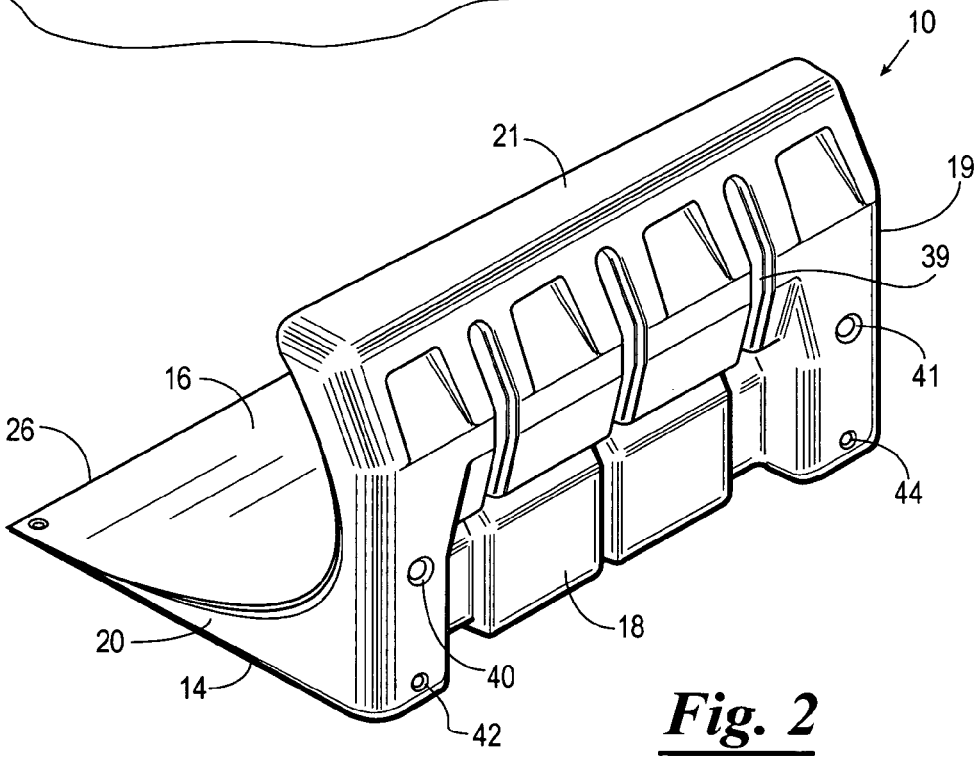
FIG. 2 is a rear perspective view of the training device of FIG. 1.
Figure 7:
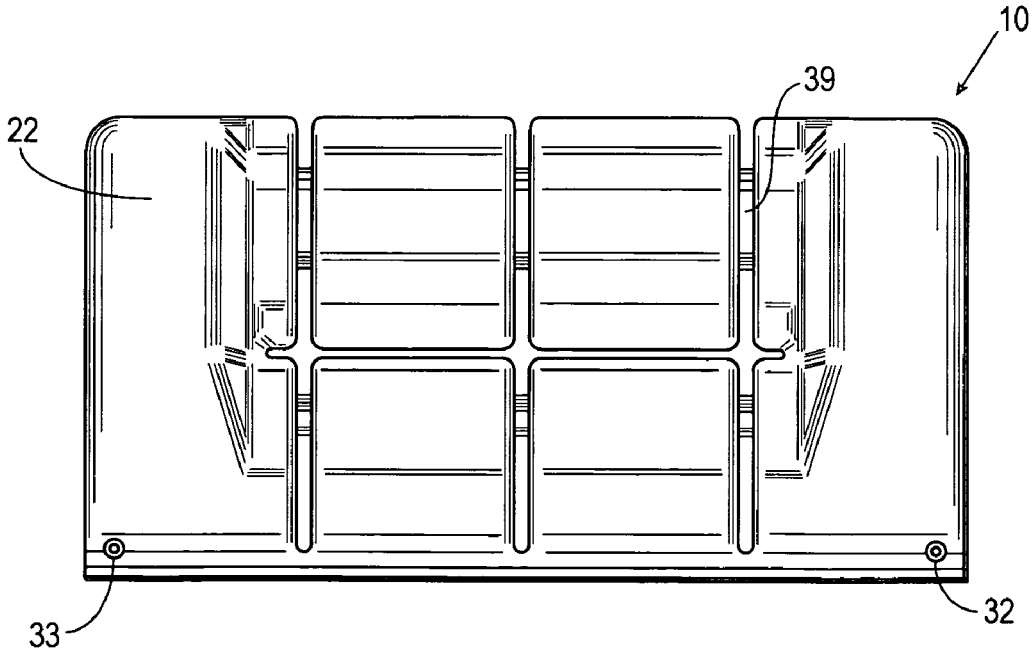
FIG. 7 is a bottom view of the training device of FIG. 1.

Referring now to FIGS. 2, 6, and 7, the rear end 18 and the bottom end 22 of the body member 14 include a plurality of indentions 39 in a manner well known in the art for reducing the volume of the ballast receiving cavity 23 (FIG. 6) within the body member 14. However, it should be understood that the plurality of indentions 39 may be varied or eliminated from the present invention without affecting the intended function thereof.

Preferably, the rear end 18 includes a pair of inlet ports 40 and 41 for inputting ballasting material into the ballast receiving cavity 23 to stabilize the training device 10. It should be understood that the inlet ports 40 and 41 may be located on the body member 14 in any area suitable for inputting ballasting material into the ballast receiving cavity 23. It should also be understood that the training device 10 may include any number of inlet ports desired.

The rear end 18 of the body member 14 further includes a pair of drainage ports 42 and 44 for releasing the ballasting material from within the ballast receiving cavity 23. As shown in FIG. 2, the drainage ports 42 and 44 are positioned below the inlet ports 40 and 41 in a linear relationship. However, it should be understood that the drainage ports 42 and 44 may be located on the body member 14 in any area suitable for draining the ballasting material from the ballast receiving cavity. It should also be understood that the training device 10 may include any number of drainage ports desired.

As mentioned above, the training device 10 is used to practice sporting activities played with a ball, such as, for example, soccer. In use, the body member 14 is placed on the ball support surface 12 so that the lower edge 26 is positioned on the ball support surface 12. A ball is projected along the ball support surface 12 toward the lower edge 26 of the concave ramp surface 24 so as to cause the ball to be received on the concave ramp surface 24 and to travel along the concave ramp surface 24 via the upper edge 28 whereby the ball is directed or looped back over the lower edge 26 and toward a user allowing the user to manipulate the ball in a desired manner.

The ball may be projected along the ball support surface 12 toward the lower edge 26 in any manner or motion desired such as, for example, by a user kicking, rolling, hitting, pushing, sliding, and the like, so as to cause the ball to be received on the concave ramp surface 24 or the ball may be projected by another individual or automatically by a machine. The ball may be directed at a selected location of the lower edge 26 of the concave ramp surface 24 and at a velocity selected by the user to achieve a desired trajectory.

Manipulation of the ball upon receipt by the user is based upon the user's identification of the trajectory of the ball once the ball exits the upper edge 28 of the concave ramp surface 24. Examples of such manipulation depends upon the desire and decision of the user. Areas of contact the user may choose to engage the ball upon receipt include, the head, shoulders, chest, knees, feet, or anywhere desired by the user.

From the above description, it is clear that the present invention is well adapted to carry out the objects and attain the advantages mentioned herein, as well as those inherent in the invention. While a presently preferred embodiment of the invention has been described herein for purposes of this disclosure, it will be understood that numerous changes may be made which will readily suggest themselves to those skilled in the art and which are accomplished within the spirit of the invention disclosed and as defined in the appended claims.

What is claimed is:

1. A training device, comprising:

a body member having a ramp surface, the ramp surface having a lower edge and an upper edge, each of the lower edge and the upper edge extending from a first side of the body member to a second side of the body member, the ramp surface being curved in a direction of extent between the lower edge and the upper edge while being non-curved in a direction perpendicular to the direction of extent between the first side and the second side along substantially the entire ramp surface between the lower edge and the upper edge, the lower edge being positionable on a ball support surface so that when a ball is put in motion along the ball support surface by a user the ball is receivable onto the ramp surface via the lower edge, the upper edge being vertically spaced from the lower edge and the ramp surface having an angle of curvature greater than 90 degrees from the lower edge to the upper edge such that the ball traveling along the ramp surface from the lower edge to the upper edge is directed back over the lower edge, the upper edge being linear from the first side to the second side and in a non-perpendicular relationship with respect to the direction of extent of the ramp surface such that the angle of curvature of the ramp surface between the lower edge and the upper edge is variable between the first side and the second side of the body member so as to permit the ball to exit the upper edge at different angles relative to the ball support surface and thereby return to the user at different trajectories.

2. The training device of claim 1 wherein the lower edge is in a perpendicular relation with respect to the direction of extent of the ramp surface.

3. The training device of claim 1 wherein the ramp surface has a ball receiving section extending from the lower edge to a horizontal plane extending normal to the ramp surface and a ball return section extending from the horizontal plane to the upper edge, and wherein the ball return section has a constant radius.

4. The training device of claim 1 wherein the radius of the ball return section is about 18 inches.

5. The training device of claim 3 wherein the ball receiving section has a variable radius.

6. The training device of claim 1 wherein the ramp surface has a ball receiving section extending from the lower edge to a horizontal plane extending normal to the ramp surface and a ball return section extending from the horizontal plane to the upper edge, and wherein the ball receiving section has a variable radius.

7. The training device of claim 1 wherein the body member defines a ballast receiving cavity and wherein the body member has an opening for receiving a ballast material.

8. A method of training for a game played with a ball, comprising:

placing a body member having a first side, a second side, and a ramp surface with a lower edge and an upper edge on a ball support surface so that the lower edge is positioned on the ball support surface, each of the lower edge and the upper edge of the ramp surface extending from the first side to the second side of the body member, the ramp surface being curved in a direction of extent between the lower edge and the upper edge while being non-curved in a direction perpendicular to the direction of extent between the first side and the second side along substantially the entire ramp surface between the lower edge and the upper edge, the upper edge being vertically spaced from the lower edge and at least a portion of the ramp surface having an angle of curvature greater than 90 degrees from the lower edge to the upper edge, the upper edge being linear from the first side to the second side and in a non-perpendicular relationship with respect to the direction of extent of the ramp surface such that the angle of curvature of the ramp surface between the lower edge and the upper edge is variable between the first side and the second side of the body member;

projecting a ball along the ball support surface and toward the lower edge of the ramp surface so as to cause the ball to be received on the ramp surface and to travel along the exit the ramp surface via the upper edge whereby the ball ramp surface from the lower edge to the upper edge and is directed back over the lower edge toward a user;

identifying the trajectory of the ball; and attempting to manipulate the ball in a desired manner.

9. The method of claim 8 wherein in the step of projecting the ball, the ball is kicked by the user.

10. The method of claim 8 wherein in the step of projecting the ball, the ball is directed at a selected location of the lower edge of the ramp surface and at a selected velocity to achieve a desired trajectory.

11. The method of claim 10 wherein in the step of projecting the ball, the ball is kicked by the user.

* * * * *

UNITED STATES PATENT AND TRADEMARK OFFICE

CERTIFICATE OF CORRECTION

PATENT NO. : 7,597,558 B2
APPLICATION NO. : 11/333947
DATED : October 6, 2009
INVENTOR(S) : Behnam Mazloompour It is certified that error appears in the above-identified patent and that said Letters Patent is hereby corrected as shown below:

In the Claims:

Column 6, line 46: After "travel along the" insert -- ramp surface from the lower edge to the upper edge and --.

Column 6, line 48: Delete "ramp surface from the lower edge to the upper edge and".

Signed and Sealed this

Seventeenth Day of November, 2009

David J. Kappos

David J. Kappos
*Director of the United States Patent and Trademark Office*